US012344420B2

(12) United States Patent
Bergen et al.

(10) Patent No.: US 12,344,420 B2
(45) Date of Patent: Jul. 1, 2025

(54) VERTICAL SEALER APPARATUS AND METHODS OF VERTICALLY SEALING

(71) Applicant: BELCO PACKAGING SYSTEMS, INC., Monrovia, CA (US)

(72) Inventors: Keith Bergen, Fullerton, CA (US); David Ian MacNeil, Glendale, CA (US)

(73) Assignee: BELCO PACKAGING SYSTEMS, INC., Monrovia, CA (US)

( * ) Notice: Subject to any disclaimer, the term of this patent is extended or adjusted under 35 U.S.C. 154(b) by 118 days.

(21) Appl. No.: 17/868,512

(22) Filed: Jul. 19, 2022

(65) Prior Publication Data

US 2023/0020790 A1 Jan. 19, 2023

Related U.S. Application Data

(60) Provisional application No. 63/223,516, filed on Jul. 19, 2021.

(51) Int. Cl.

| | |
|---|---|
| ***B65B 51/30*** | (2006.01) |
| ***B65B 9/02*** | (2006.01) |
| ***B65B 41/12*** | (2006.01) |
| ***B65B 53/06*** | (2006.01) |
| ***B65B 57/02*** | (2006.01) |
| ***B65B 61/06*** | (2006.01) |

(52) U.S. Cl.

CPC ..... *B65B 51/30* (2013.01); *B65B 9/02* (2013.01); *B65B 41/12* (2013.01); *B65B 53/063* (2013.01); *B65B 57/02* (2013.01); *B65B 61/06* (2013.01)

(58) Field of Classification Search

CPC ..... B65B 51/30; B65B 9/02; B65B 9/026; B65B 41/12; B65B 53/063; B65B 57/02; B65B 61/06

USPC ..... 53/442

See application file for complete search history.

(56) References Cited

U.S. PATENT DOCUMENTS 3,590,549 A * 7/1971 Zelnick ..... B65B 53/02 53/442
3,640,048 A * 2/1972 Zelnick ..... B65B 11/585 53/442
3,662,512 A * 5/1972 Zelnick ..... B65B 53/066 53/442
3,672,116 A * 6/1972 Ingmarson ..... B65B 9/026 53/586
3,685,233 A * 8/1972 Lassig ..... B65B 9/026 53/228
3,815,313 A * 6/1974 Heisler ..... B65B 9/026 53/64
3,884,016 A * 5/1975 Bostrom ..... B65B 9/026 53/553
3,927,507 A * 12/1975 Reid ..... B65B 51/303 53/553

(Continued)

*Primary Examiner* — Dariush Seif
(74) *Attorney, Agent, or Firm* — WOMBLE BOND DICKINSON (US) LLP

(57) ABSTRACT

A vertical sealer apparatus includes at least one conveyor for receiving objects to be wrapped in a vertical orientation with films from two film sources and for conveying the objects in a downstream direction from before and after they are wrapped along a conveying path, as well as an over for shrinking the films onto the objects. Methods of vertically sealing objects using such apparatus are also provided.

36 Claims, 5 Drawing Sheets

(56) References Cited

U.S. PATENT DOCUMENTS 3,994,116 A * 11/1976 McCormick ..... B65B 9/026 53/228
RE29,362 E * 8/1977 Reid ..... B65B 9/026 53/232
4,106,265 A * 8/1978 Aterianus ..... B65B 9/06 53/550
4,313,288 A * 2/1982 Tassi ..... B65B 41/16 53/553
4,413,463 A * 11/1983 Lancaster ..... B65B 9/026 53/399
4,499,706 A * 2/1985 Scheller ..... B65D 71/0096 53/399
4,563,859 A * 1/1986 Visser ..... B65B 9/026 53/553
4,628,668 A * 12/1986 Wildmoser ..... B65B 9/026 53/399
4,831,812 A * 5/1989 Martin Cocher ..... B65B 9/026 53/399
4,870,802 A * 10/1989 Cerf ..... B65B 9/02 53/76
5,187,922 A * 2/1993 Mast ..... B65B 9/026 53/64
5,313,766 A * 5/1994 Rimondi ..... B29C 66/1122 53/551
5,941,052 A * 8/1999 Evangelisti ..... B65B 51/303 53/511
6,880,313 B1 * 4/2005 Gessford ..... B65D 71/08 53/442
7,331,153 B1 * 2/2008 Sperry ..... B65D 75/5844 53/553
9,003,744 B2 * 4/2015 Hannen ..... B65B 11/585 53/170
11,225,342 B2 * 1/2022 Hyska ..... B65B 11/105
2002/0007617 A1 * 1/2002 Hannen ..... B65B 9/026 53/466
2003/0101688 A1 * 6/2003 Albarran ..... B65B 59/003 53/378.3
2006/0218880 A1 * 10/2006 Sperry ..... B29C 66/232 53/403
2008/0096748 A1 * 4/2008 Antonevich ..... B65B 59/001 493/267
2015/0121812 A1 * 5/2015 Cerf ..... B65B 9/026 53/442
2018/0086488 A1 * 3/2018 Campbell ..... B65B 45/00
2018/0305049 A1 * 10/2018 Wetsch ..... B32B 5/18
2019/0092507 A1 * 3/2019 Price ..... B65B 9/026
2019/0193881 A1 * 6/2019 Pecherskiy ..... B65B 31/024
2020/0207500 A1 * 7/2020 Kalinowski ..... B65B 9/06
2021/0269182 A1 * 9/2021 Orsini ..... B65B 9/067
2021/0380299 A1 * 12/2021 Kasapoglu ..... B65B 59/02
2022/0048655 A1 * 2/2022 Ponti ..... B65B 57/12
2023/0020790 A1 * 1/2023 Bergen ..... B65B 25/00
2023/0166878 A1 * 6/2023 Ponti ..... B65B 9/067 53/461

* cited by examiner

VERTICAL SEALER APPARATUS AND METHODS OF VERTICALLY SEALING

CROSS-REFERENCE TO RELATED APPLICATION

This patent application claims the benefit of U.S. Provisional Patent Application Ser. No. 63/223,516, filed on Jul. 19, 2021, and entitled "VERTICAL SEALER APPARATUS AND METHODS OF USING THE SAME" the entire content of which is hereby incorporated by reference in its entirety.

BACKGROUND

Sealers for sealing (i.e., wrapping) products in film typically require the laying of a first layer of film and then placing the product over the film. A second layer of film is placed over the product and the first layer of film and the two films are sealed together forming a complete film wrap around the product. This process may be cumbersome especially for taller products that are relatively thin such as windows. Placing windows flat on sealing systems provides a higher likelihood of the windows breaking. Furthermore, doing so requires a larger footprint of space to support a window laying down flat in comparison the footprint required for supporting a window in an upright position. As such, a more efficient system that is less prone to breakage of the product being sealed is desired.

SUMMARY

In an example embodiment, a vertical sealer apparatus includes at least one conveyor for receiving at least one object to be wrapped in a vertical orientation and for conveying the objects in a downstream direction from before and after they are wrapped along a conveying path. The apparatus also includes two film sources each for dispensing a film on either side of the object, a vertical sealer for vertically sealing the two films forming a vertically oriented seam proximate a trailing edge and proximate a leading edge of each object being wrapped, a bottom sealer for sealing the two films below a bottom end of the object forming a bottom lateral seam, and a top sealer for sealing the two films at a location above a top end of the object forming a top lateral seam. In another example embodiment, the apparatus also includes a vertical cutting element for cutting along each vertically oriented seam into a downstream seam portion and an upstream seam portion, and a lateral cutting element for cutting the two films along the top lateral seam to form a top lateral seam portion and a bottom lateral seam portion, or for cutting the two films above the top lateral seam. In yet another example embodiment, the vertical cutting element is incorporated into the vertical sealer and the lateral cutting element is incorporated into the lateral sealer. In a further example embodiment, the apparatus further includes an infeed sensor upstream of the vertical sealer for detecting a trailing edge of a first object and a leading edge of a second object, where the second object is immediately upstream of the first object, and where the first and second objects can have the same or different heights, the same or different widths and the same or different thicknesses. A gapping sensor is provided upstream of the vertical sealer and downstream of the infeed sensor for detecting a leading edge of the first and second objects, and a height sensor is provided upstream of the top sealer for detecting the height of the first and second objects, wherein the top sealer is moveable to a height for sealing the two films at a location above the detected height. In yet a further example embodiment, the apparatus also includes a top film feed upstream of the vertical sealer for receiving and forwarding top portions of the two films downstream to the vertical sealer, and a bottom film feed upstream of the vertical sealer for receiving and forwarding bottom end portions of the two films downstream to the vertical sealer. In one example embodiment, the bottom sealer is incorporated into the bottom film feed. In another example embodiment, the apparatus further includes a sealer infeed sensor upstream of the vertical sealer and downstream of the gapping sensor for detecting the leading and/or trailing edges of the second object, and a sealer discharge sensor downstream of the vertical sealer and proximate the vertical sealer for detecting the trailing edge of the first object for confirming that the trailing edge of the first object is downstream of the vertical sealer. In yet a further example embodiment, the apparatus also includes a top film discharge for receiving and supporting top portions of the first and second films above the lateral cutting element and for discharging the same. In an example embodiment, the top film discharge further includes a blower or other apparatus, as for example a conveyor, for discarding the top portions of the first and second films above the lateral cutting element by blowing them or otherwise moving them away. In another example embodiment, the at least one conveyor includes a loading conveyor, an infeed conveyor downstream of the loading conveyor, and a discharge conveyor downstream of the infeed conveyor, such that the bottom film feed is between the infeed and discharge conveyors, and the speed of each of the loading, infeed and discharge conveyors is adjustable for controlling the spacing between subsequent objects conveyed and for controlling a first spacing between the upstream seam portion and a leading edge of the second object and a second spacing between the downstream seam portion and the trailing edge of the first object. In another example embodiment, the first spacing is controlled in response to the detection of the leading edge of the second object detected by the gapping sensor and the second spacing is controlled in response to the detection of the trailing edge of the first object detected by the sealer infeed sensor. In yet another example embodiment, the infeed sensor is located along the conveying path at a location proximate the upstream end of the infeed conveyor, the gapping sensor is located along the conveying path at a location proximate the downstream end of the infeed conveyor, the sealer infeed sensor is located at a conveying path at a location proximate an downstream end of the bottom film feed, and the sealer discharge sensor is located along the conveying path at a location proximate the upstream end of the discharge conveyor. In an example embodiment, the apparatus further includes at least one jam sensor for sensing an object in a position for blocking the operation of the vertical sealer. In another example embodiment, the apparatus also includes a discharge sensor at a location along the conveying path proximate a downstream end of the discharge conveyor for detecting the trailing edge of each of each object conveyed past it. In yet another example embodiment, the apparatus further includes a shrink tunnel system including an oven, and an oven conveyor downstream of the discharge conveyor for receiving an object wrapped in the two films conveyed by the discharge conveyor and conveying the object along the conveying path vertically through the oven for shrinking the films on the object. In a further example embodiment, the apparatus also includes a vertically oriented conveyor for assisting in the conveying of the film wrapped object through the oven. In yet a further example embodiment, the vertically oriented conveyor includes a plurality of power driven vertically oriented rollers. In an example embodiment, the apparatus further includes an oven sensor along the conveying path at a location proximate a downstream end of the oven conveyor for detecting a trailing edge of the object wrapped in the films conveyed by the oven conveyor. In another example embodiment, the apparatus further includes a controller for receiving information from the infeed sensor, gapping sensor, sealer infeed sensor, sealer discharge sensor, at least one jam sensor, discharge sensor and oven sensor and for controlling the speeds of the loading, infeed, discharge, oven and vertically oriented conveyors.

In an example embodiment, a method for sealing objects with films includes conveying a first object on at least one conveyor from an upstream location to a downstream location in a downstream direction along a conveying path. The first object has a leading edge, a trailing edge, a bottom end and a top end, a first surface and second surface opposite the first surface, such that the first and second surfaces are each bounded by the leading edge, trailing edge, bottom end and top end, where the first object has a thickness defined between the first and second surfaces, a height defined between the bottom and top ends and a width defined between the leading and trailing edges, and where the bottom end is rested over the at least one conveyor for being conveyed. The method also includes providing a first film from a source of first film over the first surface and a second film from a source of second film over the second surface while conveying the first object along the conveying path, vertically sealing the first film to the second film proximate the leading edge of the first object forming a first vertically oriented seam, vertically sealing the first film to the second film proximate the trailing edge of the first object forming a second vertically oriented seam, laterally sealing the first film to the second film below the bottom end of the first object forming a first lateral seam, and laterally sealing the first film to the second film above the top end of the first object forming a second lateral seam. In another example embodiment, the method further includes shrinking the two films over the first object. In yet another example embodiment, the method also includes detecting a height of the top end of the first object and moving a lateral sealer to a location above the detected height of top end of the first object for laterally sealing the two films over the top end of the first object. In an example embodiment, the method also includes conveying a second object on the at least one conveyor upstream from the first object, the second object having a leading edge, a trailing edge, a bottom end and a top end, a first surface and second surface opposite the first surface, such that the first and second surfaces of the second object are each bounded by the leading edge, trailing edge, bottom end and top end of the second object, where the second object has a thickness defined between the first and second surfaces of the second object, a height defined between the bottom and top ends of the second object and a width defined between the leading and trailing edges of the second object, and where the bottom end of the second object is rested over the at least one conveyor for being conveyed, and wherein the first object is downstream of the second object, wherein the second object can have the same height as, or different height than, the first object, wherein the second object can have the same width as, or different width than, the first object and wherein the second object can have the same thickness as, or different thickness, than the first object. With this embodiment, the method further includes cutting the second vertically oriented seam along a vertically oriented path forming a first seam portion and a second seam portion, where the first seam portion is downstream of the second seam portion, detecting the trailing edge of the first object, detecting the leading edge of the second object, adjusting a trailing spacing between the first seam portion and the trailing edge of the first object to a desired trailing spacing, adjusting a leading spacing between the second seam portion and a leading edge of the second object to a desired leading spacing, feeding the first film from the first film source to over the first surface of the second object, and feeding the second firm from the second film source over the second surface of the second object. In a further example embodiment, the at least one conveyor includes a loading conveyor, an infeed conveyor downstream of the loading conveyor, and a discharge conveyor downstream of the infeed conveyor, where adjusting the trailing spacing includes adjusting a speed of the infeed conveyor and a speed of the discharge conveyor in response to the detection of the trailing edge of the first object, and wherein adjusting the leading spacing includes adjusting the leading spacing in response to the detection of the leading edge of the second object. In yet a further example embodiment, detecting the trailing edge of the first object includes detecting the trailing edge of the first object at a first location downstream of the infeed conveyor and prior to the formation of the second vertically oriented seam, and wherein detecting the leading edge of the second object includes detecting the leading edge of the second object at a second location along the conveying path proximate or at the downstream end of the infeed conveyor and upstream of the first location. In an example embodiment, the method further includes detecting a trailing edge of the first object at a third location along the conveying path proximate or at the downstream end of the loading conveyor and proximate or at the upstream end of the infeed conveyor, detecting the leading edge of the second object at the third location, and adjusting the spacing between the trailing edge of the first object and the leading edge of the second object in response to the detected trailing edge of the first object and the detected leading edge of the second object by adjusting a speed of the infeed conveyor and a speed of the loading conveyor. In yet another example embodiment, the method further includes detecting a height of the second object, laterally sealing the first film to the second film below the detected bottom end of the second object forming a third lateral seam, and laterally sealing the first film to the second film above the top end of the second object forming a fourth lateral seam. In a further example embodiment, the method also includes cutting top end portions of the first and second films along, or above, the fourth lateral seam, and discharging the cut top end portions of the first and second films. In yet a further example embodiment, the method further includes detecting the trailing edge of the first object wrapped by the first and second films at a fourth location proximate, or at, the downstream end of the discharge conveyor, and detecting the trailing edge of the second object wrapped by the first and second films at the fourth location. In an example embodiment, the method also includes receiving the wrapped first object from the discharge conveyor over an oven conveyor downstream of the discharge conveyor, conveying the wrapped first object with the oven conveyor through an oven for shrinking the first and second films onto the first object, and conveying the wrapped second object with the oven conveyor through the oven for shrinking the first and second films onto the second object. In another example embodiment, conveying the wrapped first object with the oven conveyor includes simultaneously conveying the first object through the oven using a vertically oriented conveyor along with the oven conveyor.

DESCRIPTION

Figure 1:
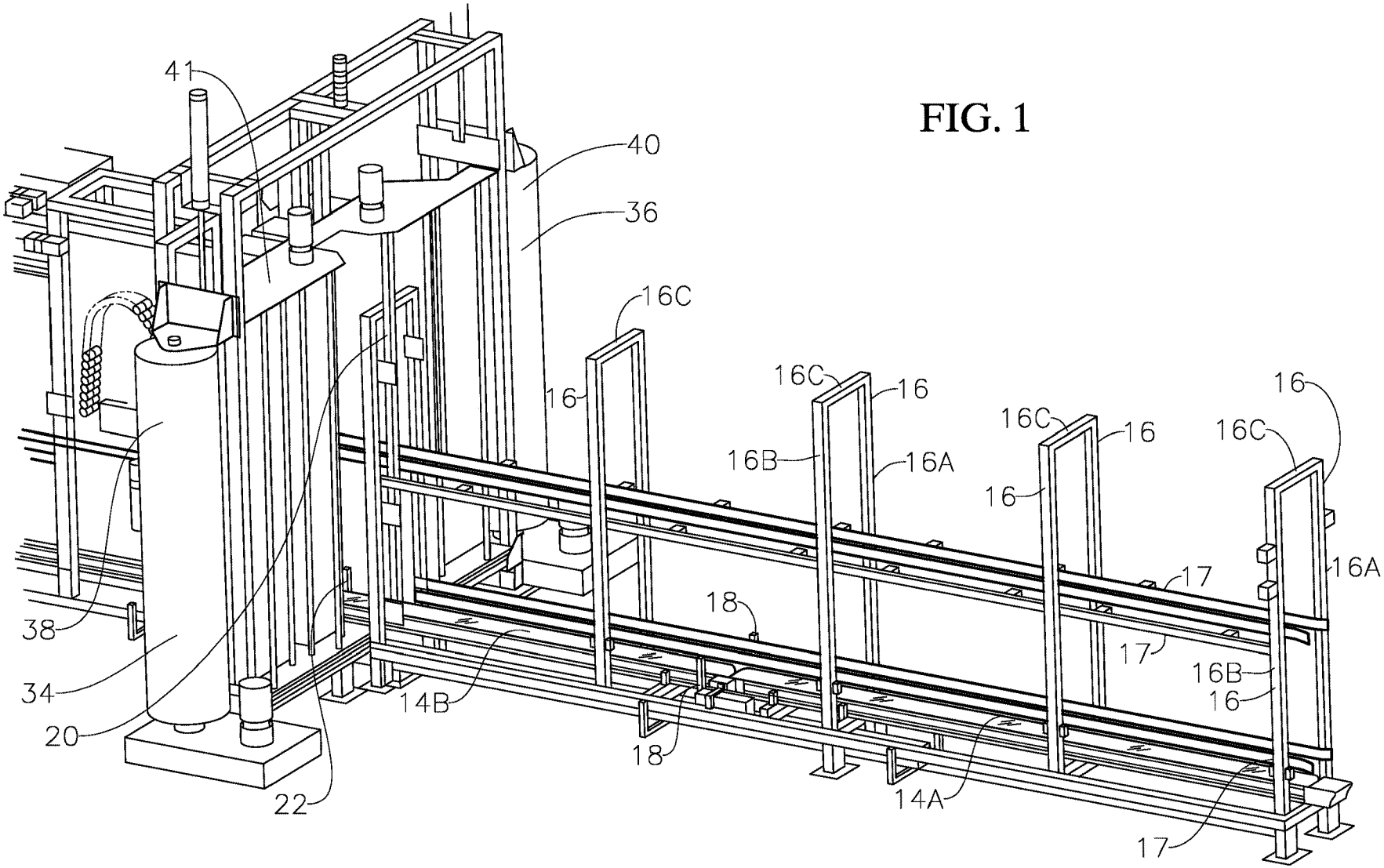
FIG. 1 is partial front perspective view of an example embodiment vertical sealer apparatus.
Figure 2:
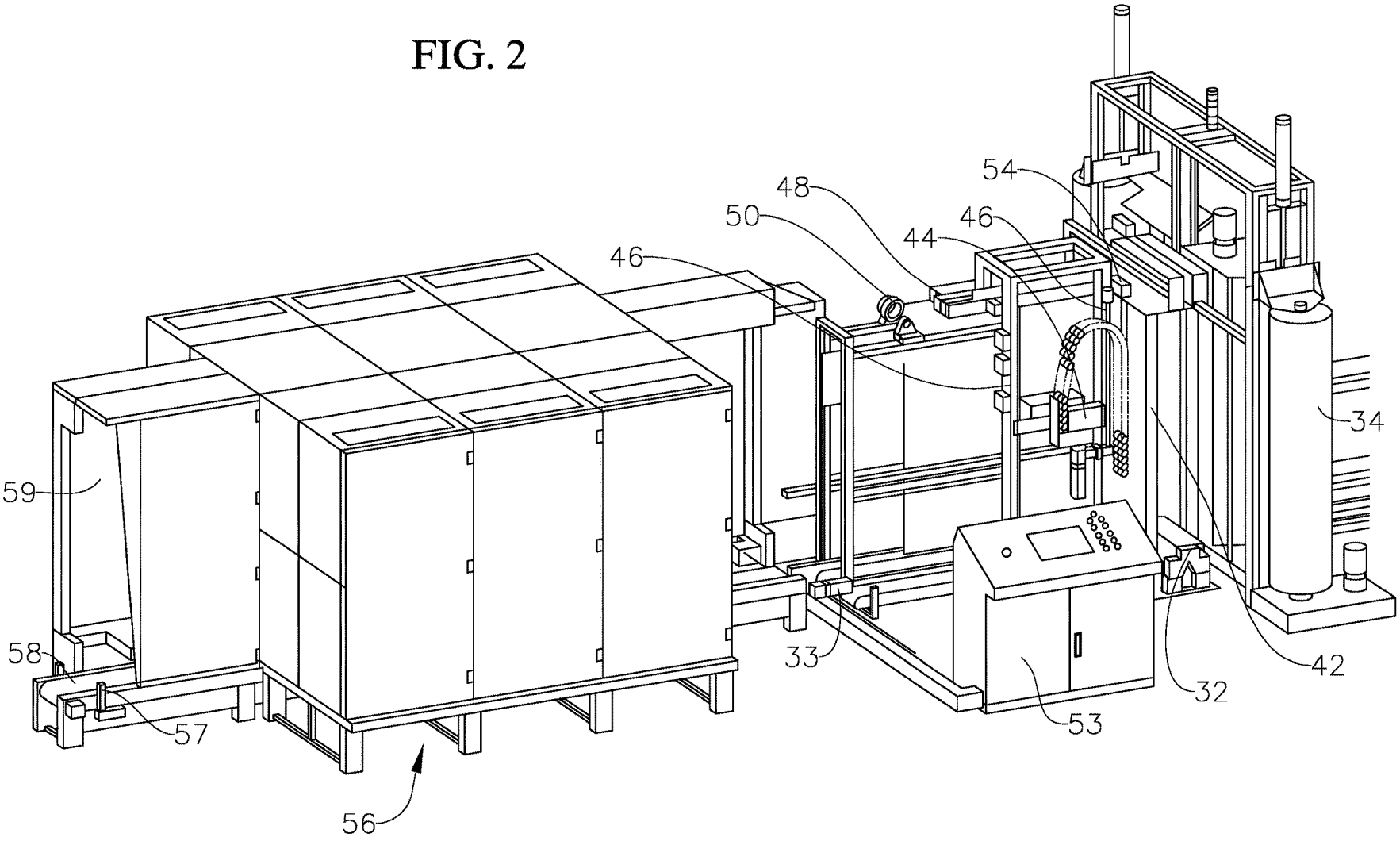
FIG. 2 is a partial rear perspective view of the example embodiment vertical sealer apparatus shown in FIG. 1.
Figure 3:
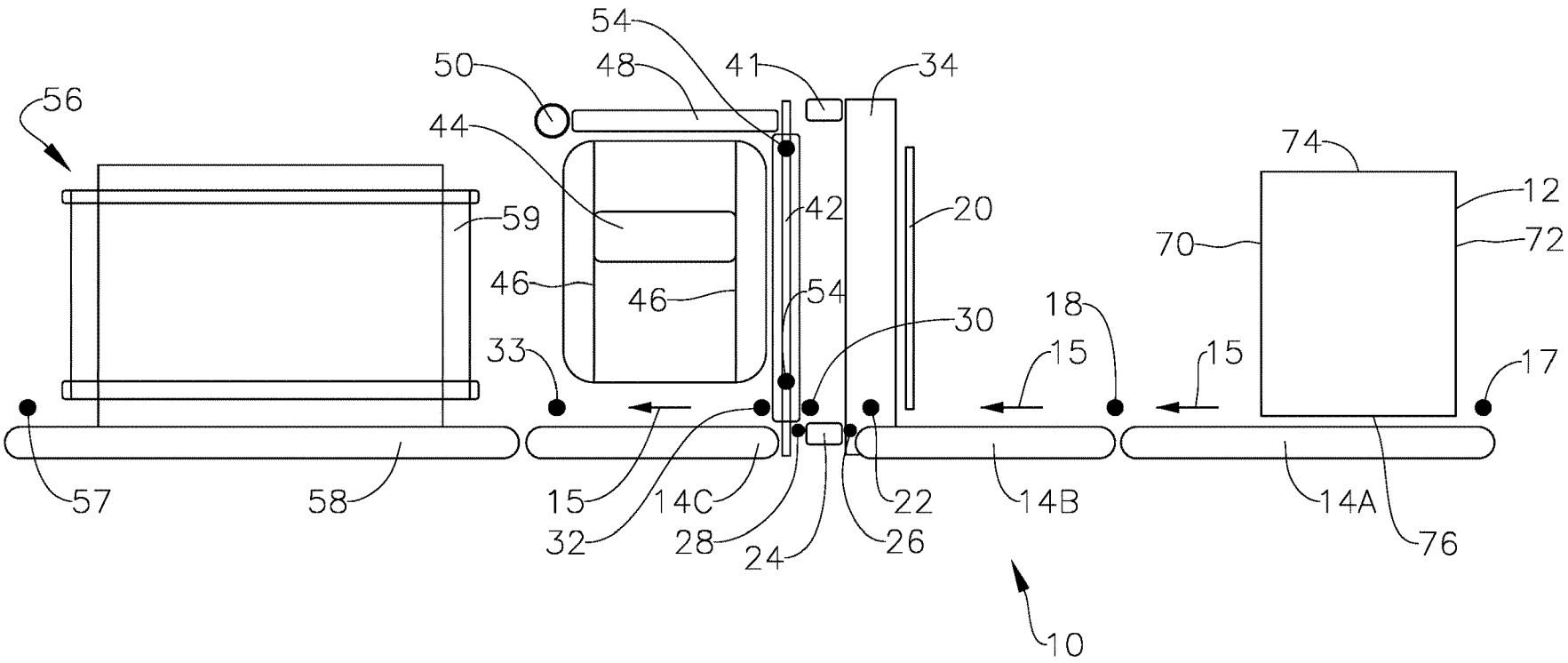
FIG. 3 is a plan schematic view of the example embodiment vertical sealer apparatus shown in FIG. 1.

A vertical sealer apparatus (also referred to herein as a "vertical sealer") 10 as described herein and shown and described in FIGS. 1-3 is used to vertically wrap different size and shapes of objects with film. The apparatus is used to seal objects by providing two opposite generally vertically oriented films and sealing the two films to each other along generally vertically oriented planes, such that the two films together cover the entire object (i.e., seal the entire object). In an example embodiment, the apparatus is useful for sealing vertically oriented objects such as windows, doors or other objects, especially objects that are relatively thinner in relation to their height and width. For illustrative purposes the apparatus is described herein for use to wrap windows 12 of the same or varying sizes.

An example embodiment vertical sealer apparatus 10 includes sequential conveyors. In an example embodiment, the sequential conveyors include a first conveyor (referred to herein as a "loading conveyor") 14A, a second conveyor (referred to herein as a "infeed conveyor") 14B, and a third conveyor (referred to herein as a "discharge conveyor") 14C for moving a window to be wrapped along a conveyance path 15. Supports 16 are provided extending vertically relative to the loading and infeed conveyors 14A, 14B, and from both sides of the loading and infeed conveyors for holding the windows in a generally upright orientation. The supports may be plates extending the length or portions of the length of the conveyors or may be bars. Horizontal guides 17 may extend horizontally along the length of the conveyor between the supports. In an example embodiment, horizontal guides are not used and the vertical supports are spaced at distances smaller than the smallest width of the windows to be wrapped. In the shown example embodiment, each support 16 is a bar and each bar has a corresponding bar on the other side of the conveyor as shown in FIG. 1. Each bar 16A and its corresponding bar 16B may be connected by an upper bar 16C. Each horizontal guide interconnects subsequent bars 16. The horizontal guide is located at distance from the conveyor shorter than the height of window when resting on the loading and infeed conveyors.

A loading sensor 17 may be provided along the conveyance path proximate, or at, the upstream end of the loading conveyor 14A. An infeed sensor 18 is provided along the conveyance path proximate the upstream end of the infeed conveyor 14B and proximate, or at, the downstream end of the loading conveyor 14A. Once the loading sensor 17 senses an object on the conveyor, the infeed sensor sends a signal to a controller 53 and the controller starts the loading conveyor. In another example embodiment a loading sensor is not provided. In such case the loading conveyor is turned on when the vertical sealer apparatuses is turned on. A height sensor 20 is provided along the conveyance path at a location between the upstream and downstream ends of the infeed conveyor. A gapping sensor 22 is provided along the conveyance path at the downstream end of the infeed conveyor 14B. A bottom film feed is located along the conveyance path between the infeed conveyor and the discharge conveyor. A bottom sealer is provided proximate or at the bottom film feed. In an example embodiment as shown in FIGS. 1 and 3, a combination 24 bottom film feed including a bottom sealer is provided. In an example embodiment, a first roller 26 may be positioned between the bottom film feed module and the infeed conveyor and a second roller 28 may be positioned between the bottom film feed module and the discharge conveyor to assist with the conveyance of a window by the infeed and discharge conveyors.

A sealer infeed sensor (SI sensor) 30 is located along the conveyance path proximate the downstream end of the bottom film fee module. A sealer discharge sensor (SD sensor) 32 is located along the conveyance path proximate, or at, the upstream end of the discharge conveyor. A discharge sensor 33 is provided along the conveyance path proximate, or at, the downstream end of the discharge conveyor.

Figure 4:
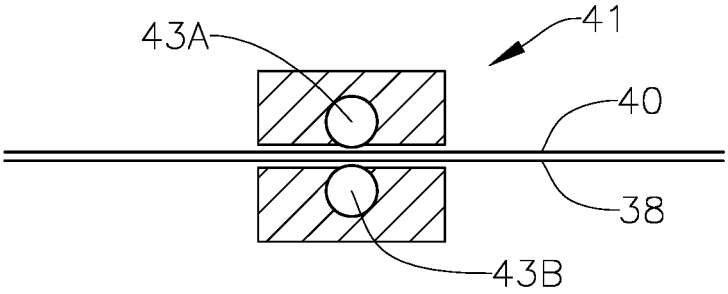
FIG. 4 is a bottom view of an example film feed incorporated in the example embodiment vertical sealer apparatus shown in FIG. 1.

Two opposing sources 34, 36 of wrapping film are positioned on either side of the infeed conveyor proximate the bottom film feed and bottom sealer 24. In the shown example embodiment, the sources of film are rolls of film. However, other sources of film may also be used. The two sources of film may be positioned on a shuttle. The sources of film are positioned such that a film 38, 40 from each film source 34, 36, respectively, extends below and above the window. In an example embodiment, the film sources are power driven by drives for dispensing film. To assist with a feed of the films, one or more film feeds may be used. In an example embodiment, as shown the bottom film feed with bottom sealer 24 is provided proximate the bottom ends of the films and a top film feed 41 is provided proximate to top ends of the films. The bottom film feed receives the bottom end portions of the two films from the two film sources and the top film feed receives the top end portions of the two films. Together the top and bottom film feeds feed the films received from the film sources in a downstream direction. A film feed, such as the top film feed 41 is a device that is capable of receiving the films and feeding it in a desired direction. Such devices are well known in the art. For example a film feed may use two or more opposite rolling elements 43A, 43B such as rollers or conveying belts, which receive the films 38, 40 between them, as for example shown in FIG. 4. The rolling elements engage the films from opposite sides and roll to feed the films forward. Instead of rolling elements, other elements that can accomplish the task of feeding the films forward may be used. A tensioner (not shown) may be used to sense the tension of each of the films between their corresponding film source and the film feed. The speed with which the film sources dispense the film is then adjusted to maintain the tension at a desired level. The tensioner may communicate directly with the film drives for adjusting the film drive speeds for maintaining the desired tension. In an example embodiment, the bottom film feed with bottom sealer simultaneously fuses the two films at, or proximate their bottom ends, using the bottom sealer while feeding the fused bottom ends of the films downstream forming a bottom lateral seam 58 (see FIG. 5).

Figure 6:
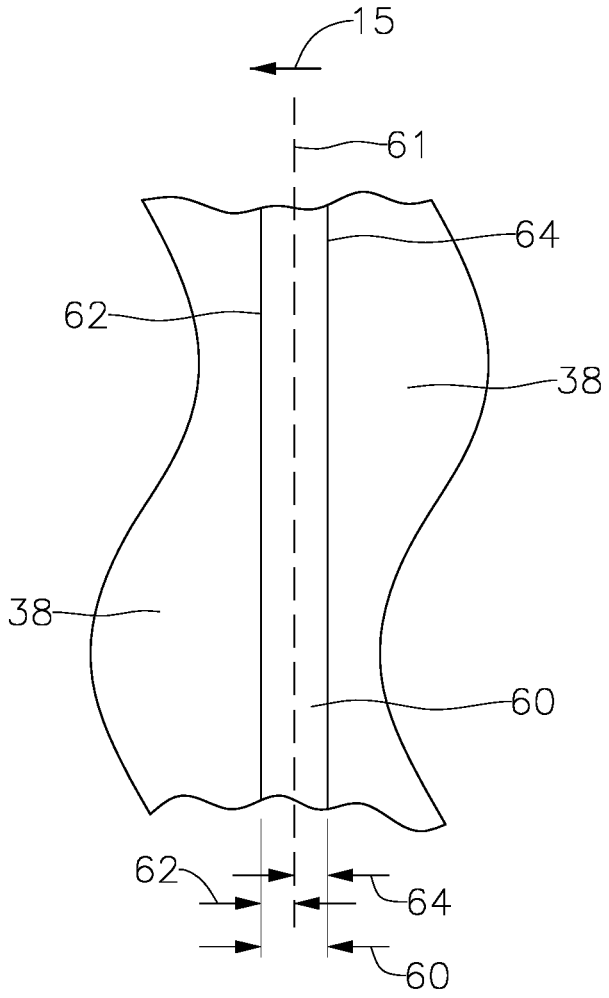
FIG. 6 is a partial view of a vertical seam created by the example embodiment vertical sealer apparatus shown in FIG. 1.

A vertical sealer 42 is located immediately adjacent the SI sensor and the SD sensor such that the SI sensor is on the upstream side of the vertical sealer and the SD sensor is on the downstream side of the vertical sealer. The vertical sealer is positioned such that it can seal the two films together along a vertically oriented path forming a vertically oriented seam 60 at a location along the conveyance path proximate, or at, the upstream end of the discharge conveyor and preferably between the discharge conveyor 14C and the bottom film feed 24 and more preferably between the second roller 28 and the upstream end of the discharge conveyor. Vertical sealers are well known in the art. The vertical sealer may include two vertically oriented elements that come together over the two films and apply heat and/or pressure to fuse them (i.e., seal them) together forming the vertically oriented seam 60, as for example shown in FIG. 6. The vertical sealer may also include a vertical cutting element that will cut the formed vertically oriented seam 60 vertically along a path 61 into two portions, on either side of the cutting element, i.e., a downstream seam portion 62 adjacent the downstream side of the cutting element and an upstream seam portion 64 adjacent the upstream side of the cutting element. In an example embodiment, the cutting element is a knife. However, other types of cutting elements that are capable of cutting the seam may be used.

Figure 5:
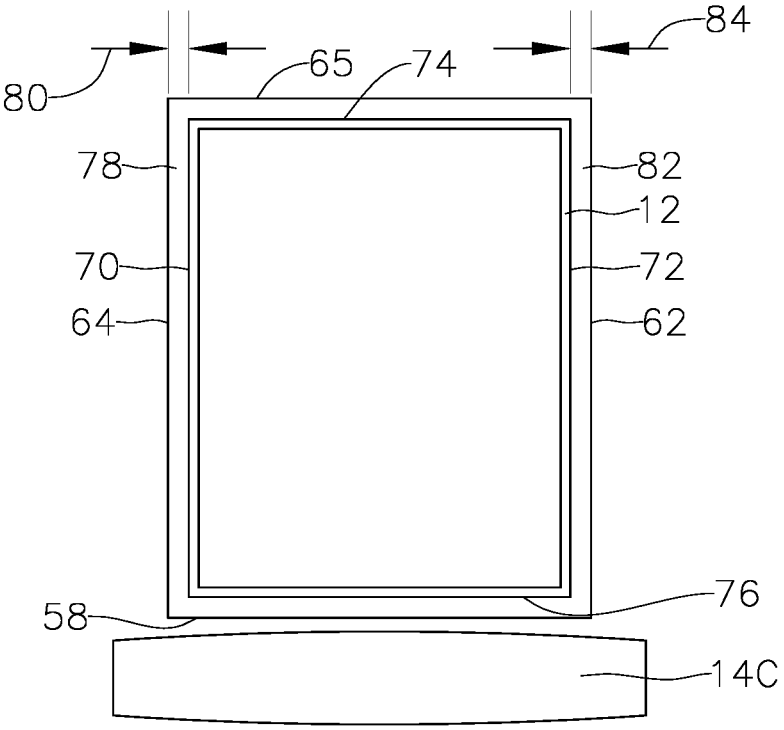
FIG. 5 is a plan schematic view of a wrapped window over a discharge conveyor incorporated in the example embodiment vertical sealer apparatus shown in FIG. 1.

A top sealer 44 is positioned to move to different heights over the discharge conveyor. The top sealer may also include two elements that come together to fuse and seal the two films above the window forming a top lateral seam 65 (FIG. 5). The top sealer may also include a cutting element to the cut the excess films above the seam or along the seam. In an example embodiment, the top sealer is moveable along rails 46 to a desired height based on the height of the window that is being covered, i.e., wrapped, and sealed by the two films. In an example embodiment, the cutting element included in the top sealer is a knife.

A film discharger 48 for receiving, holding, and feeding the top ends of the films downstream is positioned above the top sealer and above the maximum height to which the top sealer can travel. A film discharger is another type of film feed and it is a device known in the art. A scrap remover 50 may be positioned downstream the film discharger. The film scrap remover in an example embodiment includes a blower for blowing the cut top ends of the films fed to it by the film discharger. In other example embodiments, the scrap remover may be another apparatus, such as a conveyor for conveying the cut top ends of the films to a desired area.

All the sensors provide information to a central controller 53. The controller may be a computer or CPU. The central controller also controls the operation and speed of each of the conveyors. In an example embodiment, the loading conveyor is operated at a predetermined conveyance speed. A first window is placed on the loading conveyor followed by a second window and followed by a third window. Each window 12 has a leading edge 70, a trailing edge 72, a top end 74 and a bottom end 76 and opposite surface defined between the leading edge, trailing edge, top end and bottom end of each window. The windows are laterally supported by the bars and horizontal guide. Each window in conveyed by the loading conveyor 14A to the infeed conveyor 14B to the discharge conveyor 14C. The infeed sensor senses the trailing edge 72 of the first window and the leading edge 70 of the second window and provides that information to the controller. Based on this information, the controller adjusts the speed of the infeed conveyor and the loading conveyor to control the spacing between subsequent windows such as the spacing between the trailing edge of the second window and the leading edge of the third window. As the first window is conveyed by the infeed conveyor the gapping sensor senses its leading edge and sends a signal to the controller. In response, the controller controls the speed by which the top and bottom feeds feed the films past the vertical sealer. At this time an upstream seam portion has been formed by either activating the vertical sealer and vertical cutting element or by the film wrapping of a previous conveyed window. Simultaneously based on the signal received from the gapping sensor, the controller also adjusts the speed of the infeed conveyor relative to the speed of the top and bottom film feeds so as to control the spacing 78 between the already formed upstream seam portion 64 and the leading edge 70 of the first window to be at a desired predetermined dimension 80. As the bottom film feed feeds the two films, it also seals the two films together forming the bottom lateral seam 58 and guides and folds the seams to the discharge conveyor while at the same time the first window is being conveyed from the infeed conveyor to the discharge conveyor, such that the bottom lateral feed is sandwiched between the first window and the discharge conveyor. As the first window is conveyed to the discharge sensor, the SI sensor detects the trailing edge of the first window and sends a signal to the controller. In response to this signal, the controller adjusts the relative speed of the discharge conveyor relative to the top and bottom film feeds and stops the top and bottom film feeds and the discharge conveyor when the first window is at an appropriate location. When at this location, the controller activates the vertical sealer to form a vertically oriented seam (on the upstream side of the first window) and to cut the same into a downstream seam portion and an upstream seam portion such that the spacing 82 between the trailing edge of the first window and the formed downstream seam portion is at a desired predetermined dimension 84. As the window is conveyed by the discharge conveyor, the SD sensor detects the trailing edge of the first window to ensure that it has cleared the vertical sealer, before the vertical sealer is activated. At the same time, the top end portions of the two films are fed from the top film feed to the film discharge. Simultaneously, upon receiving the signal from the SD sensor, and based on the signal it has received from the height sensor, or prior to the first window being conveyed past the vertical sealer, and based on the height detected by the height sensor, the controller activates the top sealer and provides a signal moving, as necessary, the top sealer to a position at a predetermined distance above the top end of the first window. When there the top sealer forms the top lateral seal 65 and its cutting element cuts the films along, or above, the top lateral seam. The cut portions of the films above the lateral seams are then fed by the film discharge to the scrap remover for discarding the same. At this point the first window is completely wrapped by the two films which are sealed together along the perimeter of the first window. In other words both vertical seam portions intersect the top and bottom seams. The wrapped window is then conveyed by the discharge conveyor past the discharged sensor which senses the trailing edge of the window leaving the discharge conveyor. The discharge sensor sends a signal to the controller that the wrapped window has moved past the discharge conveyor.

The same process is repeated with the second window and all subsequent windows.

In an example embodiment, to prevent activation of the vertical sealer when an object in between the vertical sealer elements (that will seal the two films together along a vertically oriented path) other than the two films one or more jam sensors 54 may be provided. Once these sensors sense an object (other than the two films) between the sealing elements, they send a signal to the controller which in turn will not activate the vertical sealer.

In an example embodiment, a vertical shrink tunnel (i.e., an oven) 56 is provided for shrinking the film wrapped around the window, thereby shrink wrapping the window. In such an example embodiment, the wrapped window is conveyed into the vertical shrink tunnel 56 where heat is provided by heaters (of an oven) to shrink the wrapped film onto the window. The vertical shrink tunnel is provided with an oven conveyor 58 immediately downstream of the discharge conveyor and a vertical support conveyor 59. In an example embodiment, the vertical support conveyor includes a plurality of spaced apart vertical rollers and/or rods. In an example embodiment, a plurality of spaced apart power operated rollers and/or rods are positioned on each side of the oven conveyor. In another example embodiment, the vertical support conveyor is a conveyor having a vertically oriented conveying surface. An oven sensor 57 in provided along the conveying path proximate the downstream end of the oven conveyor and beyond the shrink tunnel. The wrapped window is conveyed by the discharge conveyor to the oven conveyor which conveys the wrapped window through the oven where the film wrapped windows are heated causing the films to shrink wrap on the window. The vertical support conveyor 59 keeps the wrapped window in an upright position while, along with the conveyor 58, conveys it along the vertical shrink tunnel.

Once the controller receives a signal from the discharge sensor, it turns on (in not already turned on) and controls the speed of the oven conveyor and the vertical support conveyor such that the wrapped window is conveyed into and maintained in the oven for an appropriate amount of time to achieve appropriate shrinking of the films onto the window. In an example embodiment, after a window is wrapped and sealed on all four sides, the speed of the discharge conveyor is adjusted (as for example, accelerated) to match the speed of the oven conveyor for a smoother transferring of the window from the discharge conveyor to the oven conveyor. In a further example embodiment, the oven conveyor is operated at a constant predetermined speed for obtaining the desired film shrinkage. The oven conveyor and the vertical support conveyor also convey the shrink wrapped window past the oven sensor 57 that detects the trailing edge of the window and provides an appropriate signal to the controller indicating that the shrink wrapped window has exited the oven. The controller also uses this signal along with a counter to determine the number of windows that have been shrink wrapped. In embodiments, where a shrink tunnel is not used, the controller can determine the number of windows wrapped based on the signal it receives from the discharge sensor.

To minimize the amount of film scrap, in an example embodiment, the apparatus may be provided with pairs of different height film sources, such as rolls of film that may be mounted on a shuttle system that moves such pairs rolls of film of a predetermined height in position for wrapping windows having heights within a specific range of heights. In an example, embodiment, a user enters the range of heights of the windows to be wrapped into the controller and the controller sends a signal to shuttle system for moving the appropriate height pair of film sources into position. In another example embodiment, the range of heights of the windows may be determined by one or more height sensors that send an appropriate signal to the shuttle relating to the sensed ranged of window heights. The controller then sends the appropriate signal to the conveyor system for moving the appropriate height pair of film sources into position. Thus, for shorter height windows a pair of sources of shorter films are moved into position, thereby minimizing the amount of film scrap created.

The sensors described herein may be any type for sensors. In one example embodiment, one or more of the sensor are through beam sensors. "Sensor" as used herein may also mean a sensor including two sensors located for example on opposite sides of a conveyed window which work together to sense the appropriate part of a window. Moreover, the location of each sensor described herein is a location along the conveying path. For example a sensor located along the conveying path at a downstream end of a conveyor can be located at any necessary vertical height relative to the conveyor as measured from a location proximate the downstream end of such conveyor.

Sealing objects such as windows with the vertical apparatus described herein provides for less breakage as they are sealed vertically and do not have to be laid down in order to be sealed or changed in orientation in order to shrink the wrapped film on them.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Moreover, although relative terms such as "outer," "inner," "upper," "lower," "above," "below," "top," "bottom," and similar terms have been used herein to describe a spatial relationship of one element to another, it is understood that these terms are intended to encompass different orientations of the various elements and components of the invention in addition to the orientation depicted in the figures. Additionally, as used herein, the term "generally," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" or "over" another component, it can be directly on or over the other component, or components may also be present therebetween. Moreover, when a component is component is referred to as being "coupled" to another component, it can be directly attached to the other component or intervening components may be present therebetween. In addition, the terms "first", "second", and "third" when referring to components are just labels for distinguishing such components from each other and are not the generic names of such components. For example, a component described as a "first" component in the specification may be recited in the claims as a "second" component.

The invention claimed is:

1. A vertical sealer apparatus comprising:

at least one conveyor for receiving a plurality of objects, to be wrapped, in a generally vertical orientation and for conveying the plurality of objects in a generally vertical orientation with a top end of each of said plurality of objects being above a bottom end of said each of said plurality of objects and being distally above the conveyor, and in a downstream direction from before and after they are wrapped along a conveying path;

two film rolls each for dispensing a film on either side of each of the plurality of objects;

a vertical sealer for vertically sealing the two films forming a vertically oriented seam proximate a trailing edge and proximate a leading edge of each of said plurality of objects being wrapped, wherein the top end of each of said plurality of objects extends between the trailing edge and leading edge of said object;

a bottom sealer for sealing the two films below the bottom end of each of the plurality of objects forming a bottom lateral seam; and a top sealer for sealing the two films at a location above the top end of each of the plurality of objects forming a top lateral seam; and a height sensor for detecting the height of each of the plurality of objects while being conveyed by said at least one conveyor, wherein the top sealer is moveable to different heights to seal the two films above the top end and between the trailing edge and leading edge of each of said plurality of objects in response the height detected by said height sensor.

2. The apparatus as recited in claim 1, further comprising:

a vertical cutting element for cutting along said each of said vertically oriented seams into a downstream seam portion and an upstream seam portion; and a lateral cutting element for cutting the two films along the top lateral seam to form a top lateral seam portion and a bottom lateral seam portion or for cutting the two films above the top lateral seam.

3. The apparatus as recited in claim 2, wherein the vertical cutting element is incorporated into the vertical sealer and wherein the lateral cutting element is incorporated into the top sealer.

4. The apparatus as recited in claim 2, further comprising:

an infeed sensor upstream of the vertical sealer for detecting a trailing edge of a first object of said plurality of objects and a leading edge of a second object of said plurality of objects, wherein the second object is immediately upstream of the first object, and wherein the first and second objects can have the same or different heights, the same or different widths and the same or different thicknesses; and a gapping sensor upstream of the vertical sealer and downstream of the infeed sensor for detecting a leading edge of the first and second objects, wherein the height sensor is upstream of the top sealer for detecting the height of the first and second objects when conveyed past the height sensor.

5. The apparatus as recited in claim 4, further comprising:

a top film feed upstream of the vertical sealer for receiving and forwarding top portions of the two films downstream to the vertical sealer; and a bottom film feed upstream of the vertical sealer for receiving and forwarding bottom of portions of the two films downstream to the vertical sealer.

6. The apparatus as recited in claim 5, wherein the bottom sealer is incorporated into the bottom film feed.

7. The apparatus as recited in 5, further comprising:

a sealer infeed sensor upstream of the vertical sealer and downstream of the gapping sensor for detecting at least one of the leading and trailing edge of the second object when conveyed past said sealer infeed sensor; and a sealer discharge sensor downstream of the vertical sealer and proximate the vertical sealer for detecting the trailing edge of the first object for confirming that said trailing edge of said first object is downstream of said vertical sealer.

8. The apparatus as recited in claim 7, further comprising a top film discharge for receiving and supporting top portions of the first and second films above the lateral cutting element and discharging the same.

9. The apparatus as recited in claim 8, wherein the top film discharge further comprises a blower or a conveyor for discharging the top portions of the first and second films above the lateral cutting element.

10. The apparatus as recited in claim 8, wherein said at least one conveyor comprises:

a loading conveyor;

an infeed conveyor adjacent and downstream of the loading conveyor; and a discharge conveyor downstream of the infeed conveyor, wherein the bottom film feed is between the infeed and discharge conveyors, wherein the speed of each of said loading, infeed and discharge conveyors is adjustable for controlling the spacing between subsequent objects conveyed and for controlling a first spacing between the upstream seam portion and a leading edge of the second object and a second spacing between the downstream seam portion and the trailing edge of the first object.

11. The apparatus as recited in claim 10, wherein the first spacing is controlled in response to the detection of the leading edge of the second object detected by the gapping sensor and wherein the second spacing is controlled in response to the detection of the trailing edge of the first object detected by the sealer infeed sensor.

12. The apparatus as recited in claim 10, wherein the infeed sensor is located along the conveying path at a location proximate the upstream end of the infeed conveyor, the gapping sensor is located along the conveying path at a location proximate the downstream end of the infeed conveyor, the sealer infeed sensor is located along the conveying path proximate a downstream end of the bottom film feed, and wherein the sealer discharge sensor is located along the conveying path at a location proximate the upstream end of the discharge conveyor.

13. The apparatus as recited in claim 12, further comprising at least one jam sensor for sensing an object in a position for blocking the operation of the vertical sealer.

14. The apparatus as recited in claim 13, further comprising a discharge sensor along the conveying path at a location proximate a downstream end of the discharge conveyor for detecting the trailing edge of each of each object conveyed past it.

15. The apparatus as recited in claim 14, further comprising a shrink tunnel apparatus comprising:

an oven; and an oven conveyor downstream of the discharge conveyor for receiving an object wrapped in said two films conveyed by the discharge conveyor and conveying said object through the oven for shrinking said films on said object along the conveying path.

16. The apparatus as recited in claim 15, further comprising a vertically oriented conveyor for assisting in the conveying of the film wrapped object through the oven.

17. The apparatus as recited in claim 16, wherein said vertically oriented conveyor comprises a plurality of power driven rollers for vertically conveying said wrapped object.

18. The apparatus as recited in claim 17, further comprising an oven sensor located along the conveying path at a location proximate the downstream end of the oven conveyor for detecting a trailing edge of said object wrapped in said films conveyed by said oven conveyor.

19. The apparatus as recited in claim 18, further comprising a controller for receiving information from said infeed sensor, gapping sensor, sealer infeed sensor, sealer discharge sensor, at least one jam sensor, discharge sensor and oven sensor and for controlling the speeds of said loading, infeed, discharge, oven and vertically oriented conveyors.

20. A method for sealing objects with films comprising:

conveying a first object on at least one conveyor from an upstream location to a downstream location in a downstream direction along a conveying path, said first object having a leading edge, a trailing edge, a bottom end and a top end above the bottom end and extending between the leading edge and trailing edge, a first surface and second surface opposite the first surface, wherein the first and second surfaces are each bounded by said leading edge, trailing edge, bottom end and top end, wherein said first object has a thickness defined between said first and second surfaces, a height defined between the bottom and top ends and a width defined between the leading and trailing edges, and wherein the bottom end is rested over said at least one conveyor for being conveyed;

providing a first film from a source of first film over the first surface and a second film from a source of second film over the second surface while conveying said first object in said downstream direction;

vertically sealing the first film to the second film proximate the leading edge of the first object forming a first vertically oriented seam;

vertically sealing the first film to the second film proximate the trailing edge of the first object forming a second vertically oriented seam;

laterally sealing the first film to the second film below the bottom end of the first object forming a first lateral seam; and detecting a height of the top end of said first object while being conveyed along the conveying path and moving a lateral sealer in response to said detected height to a location above the detected height of the top end of the first object for laterally sealing said two films over the top end of the first object forming a second lateral seam between the first vertically oriented seam and the second vertically oriented seam.

21. The method as recited in claim 20, further comprising shrinking said two films over said first object.

22. The method as recited in claim 20, further comprising:

conveying a second object on said at least one conveyor upstream from said first object, said second object having a leading edge, a trailing edge, a bottom end and a top end, a first surface and second surface opposite the first surface, wherein the first and second surfaces of said second object are each bounded by said leading edge, trailing edge, bottom end and top end of said second object, wherein said second object has a thickness defined between the first and second surfaces of said second object, a height defined between the bottom and top ends of said second object and a width defined between the leading and trailing edges of said second object, and wherein the bottom end of said second object is rested over said at least one conveyor for being conveyed, said first object being downstream of said second object, wherein said second object can have the same height as, or a different height than, the first object, wherein said second object can have the same width as, or a different width than, the first object, and wherein said second object can have the same thickness as, or different thickness than, the first object;

cutting the second vertically oriented seam along a vertically oriented path forming a first seam portion and a second seam portion, wherein the first seam portion is downstream of the second seam portion;

detecting the trailing edge of the first object;

detecting the leading edge of the second object;

adjusting a trailing spacing between the first seam portion and the trailing edge of the first object to a desired trailing spacing;

adjusting a leading spacing between the second seam portion and a leading edge of the second object to a desired leading spacing;

feeding the first film from the first film source to over the first surface of the second object; and feeding the second firm from the second film source over the second surface of the second object.

23. The method as recited in claim 22, wherein said at least one conveyor comprises a loading conveyor, an infeed conveyor downstream of the loading conveyor, and a discharge conveyor downstream of the infeed conveyor, wherein adjusting the trailing spacing comprises adjusting a speed of the infeed conveyor and a speed of the discharge conveyor in response to the detection of the trailing edge of said first object, and wherein adjusting the leading spacing comprises adjusting the leading spacing in response to the detection of the leading edge of the second object.

24. The method as recited in claim 23, wherein detecting the trailing edge of the first object comprises detecting the trailing edge of the first object at a first location downstream of the infeed conveyor and prior to the formation of the second vertically oriented seam, and wherein detecting the leading edge of the second object comprises detecting the leading edge of the second object at a second location along the conveying path proximate, or at, the downstream end of the infeed conveyor and upstream of the first location.

25. The method as recited in claim 24, further comprising:

detecting the trailing edge of the first object at a third location proximate, or at, the downstream end of the loading conveyor and proximate, or at, the upstream end of the infeed conveyor;

detecting the leading edge of the second object at said third location; and adjusting the spacing between the trailing edge of the first object and the leading edge of the second object in response to said detected trailing edge of the first object and said detected leading edge of the second object by adjusting a speed of the infeed conveyor and a speed of the loading conveyor.

26. The method as recited in claim 25, further comprising;

cutting top end portions of the first and second films along or above the fourth lateral seam; and discharging said cut top end portions of the first and second films.

27. The method as recited in claim 26, further comprising:

detecting the trailing edge of the first object wrapped by said first and second films at a fourth location proximate, or at, the downstream end of the discharge conveyor; and detecting the trailing edge of the second object wrapped by said first and second films at said fourth location.

28. The method as recited in claim 27, further comprising:

receiving said wrapped first object from said discharge conveyor on an oven conveyor downstream of the discharge conveyor;

conveying said wrapped first object with the oven conveyor through an oven for shrinking the first and second films onto the first object; and conveying said wrapped second object with the oven conveyor through the oven for shrinking the first and second films onto the second object.

29. The method as recited in claim 28, wherein conveying said wrapped first object with the oven conveyor comprises simultaneously conveying said wrapped first object and said wrapped second object through the oven using a vertically oriented conveyor.

30. The method as recited in claim 24, further comprising:

detecting a height of the second object;

laterally sealing the first film to the second film below the bottom end of the second object forming a third lateral seam; and laterally sealing the first film to the second film above the detected height of the top end of the second object forming a fourth lateral seam.

31. A method for sealing objects with films comprising:

conveying a first object on at least one conveyor from an upstream location to a downstream location in a downstream direction along a conveying path, said first object having a leading edge, a trailing edge, a bottom end and a top end, a first surface and second surface opposite the first surface, wherein the first and second surfaces are each bounded by said leading edge, trailing edge, bottom end and top end, wherein said first object has a thickness defined between said first and second surfaces, a height defined between the bottom and top ends and a width defined between the leading and trailing edges, and wherein the bottom end is rested over said at least one conveyor for being conveyed;

providing a first film from a source of first film over the first surface and a second film from a source of second film over the second surface while conveying said first object in said downstream direction;

vertically sealing the first film to the second film proximate the leading edge of the first object forming a first vertically oriented seam;

vertically sealing the first film to the second film proximate the trailing edge of the first object forming a second vertically oriented seam;

laterally sealing the first film to the second film below the bottom end of the first object forming a first lateral seam;

laterally sealing the first film to the second film above the top end of the first object forming a second lateral seam;

conveying a second object on said at least one conveyor upstream from said first object, said second object having a leading edge, a trailing edge, a bottom end and a top end, a first surface and second surface opposite the first surface, wherein the first and second surfaces of said second object are each bounded by said leading edge, trailing edge, bottom end and top end of said second object, wherein said second object has a thickness defined between the first and second surfaces of said second object, a height defined between the bottom and top ends of said second object and a width defined between the leading and trailing edges of said second object, and wherein the bottom end of said second object is rested over said at least one conveyor for being conveyed, said first object being downstream of said second object, wherein said second object can have the same height as, or a different height than, the first object, wherein said second object can have the same width as, or a different width than, the first object, and wherein said second object can have the same thickness as, or different thickness than, the first object;

cutting the second vertically oriented seam along a vertically oriented path forming a first seam portion and a second seam portion, wherein the first seam portion is downstream of the second seam portion;

detecting the trailing edge of the first object;

detecting the leading edge of the second object;

adjusting a trailing spacing between the first seam portion and the trailing edge of the first object to a desired trailing spacing;

adjusting a leading spacing between the second seam portion and a leading edge of the second object to a desired leading spacing;

feeding the first film from the first film source to over the first surface of the second object;

feeding the second firm from the second film source over the second surface of the second object, wherein said at least one conveyor comprises a loading conveyor, an infeed conveyor downstream of the loading conveyor, and a discharge conveyor downstream of the infeed conveyor, wherein adjusting the trailing spacing comprises adjusting a speed of the infeed conveyor and a speed of the discharge conveyor in response to the detection of the trailing edge of said first object, wherein adjusting the leading spacing comprises adjusting the leading spacing in response to the detection of the leading edge of the second object, wherein detecting the trailing edge of the first object comprises detecting the trailing edge of the first object at a first location downstream of the infeed conveyor and prior to the formation of the second vertically oriented seam, and wherein detecting the leading edge of the second object comprises detecting the leading edge of the second object at a second location along the conveying path proximate, or at, the downstream end of the infeed conveyor and upstream of the first location;

detecting the trailing edge of the first object at a third location proximate, or at, the downstream end of the loading conveyor and proximate, or at, the upstream end of the infeed conveyor;

detecting the leading edge of the second object at said third location; and adjusting the spacing between the trailing edge of the first object and the leading edge of the second object in response to said detected trailing edge of the first object and said detected leading edge of the second object by adjusting a speed of the infeed conveyor and a speed of the loading conveyor.

32. The method as recited in claim 31, further comprising:

detecting a height of the second object;

laterally sealing the first film to the second film below the bottom end of the second object forming a third lateral seam; and laterally sealing the first film to the second film above the detected height of the top end of the second object forming a fourth lateral seam.

33. The method as recited in claim 31, further comprising;

cutting top end portions of the first and second films along or above the fourth lateral seam; and discharging said cut top end portions of the first and second films.

34. The method as recited in claim 33, further comprising:

detecting the trailing edge of the first object wrapped by said first and second films at a fourth location proximate, or at, the downstream end of the discharge conveyor; and detecting the trailing edge of the second object wrapped by said first and second films at said fourth location.

35. The method as recited in claim 34 further comprising:

receiving said wrapped first object from said discharge conveyor on an oven conveyor downstream of the discharge conveyor;

conveying said wrapped first object with the oven conveyor through an oven for shrinking the first and second films onto the first object; and conveying said wrapped second object with the oven conveyor through the oven for shrinking the first and second films onto the second object.

36. The method as recited in claim 35, wherein conveying said wrapped first object with the oven conveyor comprises simultaneously conveying said wrapped first object and said wrapped second object through the oven using a vertically oriented conveyor.

* * * * *